US005892166A

United States Patent [19]

Sanderson

[11] Patent Number: 5,892,166

[45] Date of Patent: Apr. 6, 1999

[54] WOUND STRINGS FOR MUSICAL INSTRUMENT

[75] Inventor: Albert E. Sanderson, Carlisle, Mass.

[73] Assignee: Inventronics, Inc., Chelmsford, Mass.

[21] Appl. No.: 862,827

[22] Filed: May 23, 1997

[51] Int. Cl.[6] ..... G10D 3/00

[52] U.S. Cl. ..... 84/297 S; 84/199

[58] Field of Search ..... 84/297 S, 197, 84/198, 199

[56] References Cited

U.S. PATENT DOCUMENTS

| | | | |
|---|---|---|---|
| 210,172 | 11/1878 | Watson et al. | 84/199 |
| 478,746 | 7/1892 | Gill | 84/199 |
| 2,049,769 | 8/1936 | Gray | 84/199 |
| 2,746,335 | 5/1956 | Johnson | 84/199 |
| 3,605,544 | 9/1971 | Kondo | 84/199 |
| 3,968,719 | 7/1976 | Sanderson | 84/454 |
| 4,055,038 | 10/1977 | Conklin, Jr. | 57/11 |
| 4,135,429 | 1/1979 | Heyne | 84/199 |
| 4,184,405 | 1/1980 | How | 84/297 |
| 4,276,805 | 7/1981 | Kaneko | 84/458 |
| 4,383,465 | 5/1983 | Conklin, Jr. | 84/199 |
| 5,285,711 | 2/1994 | Sanderson | 84/454 |
| 5,535,658 | 7/1996 | Kalosdian | 84/297 S |

*Primary Examiner*—William M. Shoop, Jr.
*Assistant Examiner*—Shih-yung Hsieh
*Attorney, Agent, or Firm*—Pearson & Pearson

[57] ABSTRACT

A wound musical string includes a core wire and a wrapped wire covering about the core wire. End turns of the wrapped wire covering are coextensive portions of transition sections of the core wire. The transition sections have equilateral triangular, square or other cross sections such that the cross section exhibits equal principal moments of inertia. Consequently the inharmonicity of the string about two axes will be the same and the string will not produce false beats.

21 Claims, 7 Drawing Sheets

10

WOUND STRINGS FOR MUSICAL INSTRUMENT

BACKGROUND OF THE INVENTION

1. Field of the Invention

This invention generally relates to strings for producing musical tones and more particularly to the construction of improved wound musical strings and the method of making such strings.

2. Description of Related Art

When metal strings, typically steel strings, are placed in tension and struck or plucked, they vibrate and produce a musical tone. Some of these strings merely comprise a simple steel core wire, as used for treble notes in a piano. At lower frequencies, the string length increases. String lengths for the lowest notes become very long and cannot be incorporated in many pianos, such as spinet, upright and small grand pianos.

As known in the art, strings for the lower notes therefore incorporate a copper wrapping wire wound about a central portion of the core wire to load the wire and produce a tone with a string of significantly shorter length than would be required without the wrapping wire. Strings in the bass region may include one to three concentric windings. Each concentric winding has an intermediate section between two end turn sections.

U.S. Pat. No. 4,005,038 (1977) to Conklin, Jr. discloses an apparatus for wrapping strings for musical instruments that represents the conventional approach for producing such strings. The final wound string comprises a core wire of circular cross section. A single-, double- or triple-winding is coextensive with a central or intermediate length of the core wire. End turns of each winding wrap around a flattened area on the core wire produced by swaging or other similar technique. Winding the end turns around the swaged portion prevents the end turns from rotating on the core wire and loosening the entire wire wrap. Consequently in this form the core wire is circular except for the flattened transition areas that are coextensive with the end turns.

Many wound strings constructed in this conventional approach exhibit "false beats" when struck. It is generally recognized that one cause of false beats lies in the boundary conditions of orthogonal modes of vibration. More specifically such musical strings vibrate with components in various planes that shift around major axes displaced by 90°. For example, in a horizontal string, the major axes are typically designated as the horizontal and vertical axes.

Tones emitted in the two orthogonal modes do not necessarily have identical speaking lengths. For example, in a piano it is quite possible for the pin that terminates the horizontal mode to be displaced from the corner of the bridge notching that terminates the vertical mode of vibration. Good bridge notching places the edge of the notch in line with the center line of the bridge pin to prevent false beats.

If the vibration components in both axes do not have identical frequencies, the difference represents a false beat. While the difference or false beat frequency may be minimal at the fundamental tone for the string, the frequency is multiplied by the partial number. Consequently at four octaves above the fundamental, the false beat frequency is sixteen times the beat frequency at the fundamental. Even if a string produces only a low slow frequency false beat in the low bass region, the overtones in the audible range beat much faster and thereby produce undesirable sounds. When objectionable false beats are detected, piano tuners generally replace the offending string in hopes that the problem will disappear because the effects from string to string tend to be random. The randomness comes from the possibility that the two ends can add or cancel depending on the orientation of the flats at each end.

Over the years a number of alternative string constructions have been proposed for a number of different purposes including the improvement of tonal quality. For example, U.S. Pat. No. 210,172 (1878) to Watson et al. and Great Britain Patent No. 300 (1885) to Hassel collectively disclose wound piano strings with core wires having triangular, oval, quadrangular, pentagonal or other polygonal cross sections. Both patents propose these cross sections to prevent loosening or longitudinal displacement of the wrapping wire on the core wire in a wound string.

U.S. Pat. No. 3,605,544 (1971) to Kondo discloses a string in which the end turns are wrapped in a contiguous fashion about a core wire. Intermediate turns, however, are spaced to eliminate undesirable resonances, buzzes or other noises, that is, to improve tonal quality.

U.S. Pat. No. 478,746 (1892) to Gill discloses another approach for improving tone quality. A string, whether wound or unwound, is formed with a triangular, rectangular or half-round cross section. In accordance with the Gill patent, however, any flat portion is located immediately above the corresponding note hammer so that the hammer strikes the flattened portion. This feature is stated to reduce hammer wear. In addition it is suggested that the string be twisted along its length to improve tone quality.

None of these references addresses the particular source of undesirable tone quality produced by false beats. Moreover none of the approaches suggested by these references seems to have been adopted in any wide-spread fashion. Pianos, particularly, continue to be manufactured with wound strings according to a method and construction as disclosed in the above-identified Conklin patent and other references. Moreover the cure for false beats when detected continues to be replacing the offending string.

SUMMARY OF THE INVENTION

Therefore it is an object of this invention to provide a musical string that will eliminate one cause of false beats.

Another object of this invention is to provide a wound musical string that minimizes the occurrence of false beats.

Still another object of this invention is to provide a method for making a musical string that will eliminate one cause of false beats.

Still yet another object of this invention is to provide a method for making a wound musical string that is essentially not susceptible to the generation of false beats.

In accordance with this invention a musical string comprises a core wire and a wound wire covering that has intermediate turns and end turns. The core wire extends beyond the wound wire covering to define opposite bare end sections. An intermediate section that is coextensive with the intermediate turns of the wound wiring covering, terminates at each end in a transition section that lies between the intermediate section and a bare end section. Each of the bare end and intermediate sections of the core wire has a circular cross section. Each of the transition sections has a cross section that exhibits equal principal moments of inertia.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF ILLUSTRATIVE EMBODIMENTS

Figure 1:
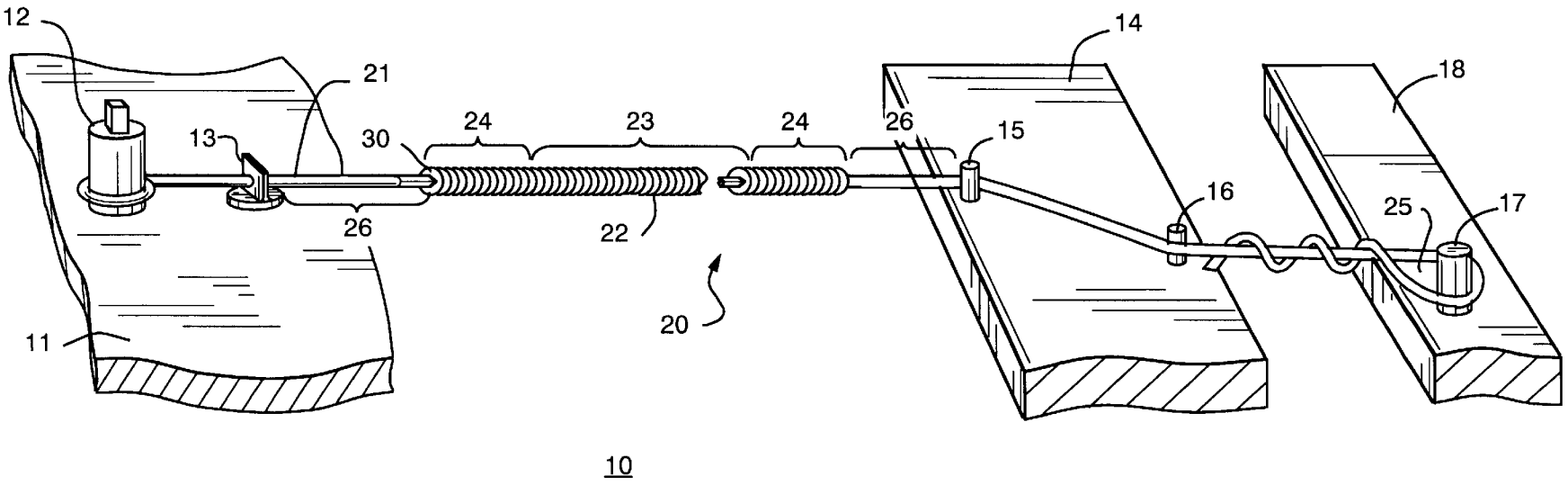
FIG. 1 is a perspective view of a portion of a piano and a single-wound bass string constructed in accordance with this invention.

As shown in FIG. 1, a piano 10 includes a tuning block 11 carrying a tuning pin 12 and an agraffe 13. A bridge 14, spaced from the tuning block 11, carries bridge pins 15 and 16. A hitch pin 17 terminates the string. This construction is well known in the art. FIG. 1 also depicts a wrapped piano string in the form of single wound bass string 20 formed with a core wire 21 and a wound wire covering 22. In FIG. 1 the wound wire covering 22 divides into a single-layer wrap with intermediate turns 23, that constitute the dominant portion of the wrapping wire 22, and opposite end turns 24. The length of this wrapping is determined by known prior art techniques as described in the aforementioned Conklin patent and other references.

When the string is installed on the piano 10, one end of the core wire 21 extends past bridge pins 15 and 16 to form an eye 25 held in place and tension on the hitch pin 17. The other end attaches to the tuning pin 12. Consequently one bare end 26 extends from the bridge pin 15 to the adjacent end turns 24. At the block 11, a bare end 26 extends between the agraffe 13 and the adjacent end turns 24.

Still referring to FIG. 1, the distance between the agraffe 13 and the bridge pin 15 defines the speaking length, $L_s$, of the musical instrument string 20. As known, the inharmonicity introduced by the core wire 21 with respect to the wound or intermediate portion is given by $$B_{core} = \frac{(330d)^4}{TL_s^2} \tag{1}$$

where d and T are the diameter and tension of the core wire 21.

When the musical string 20 shown in FIG. 1 is struck, it produces a fundamental frequency and a plurality of other frequencies, known as overtones or partials. The difference between the partial and corresponding harmonic is the inharmonicity of the piano wire. Inharmonicity depends literally on both the area and the moment of inertia of the cross section of the wire. At any partial, n, inharmonicity for that partial, $I_n$, rises as the square of the partial number, n, and linearly with respect to the inharmonicity factor, B; that is:

$$I_n = Bn^2 \tag{2}$$

Figure 2:
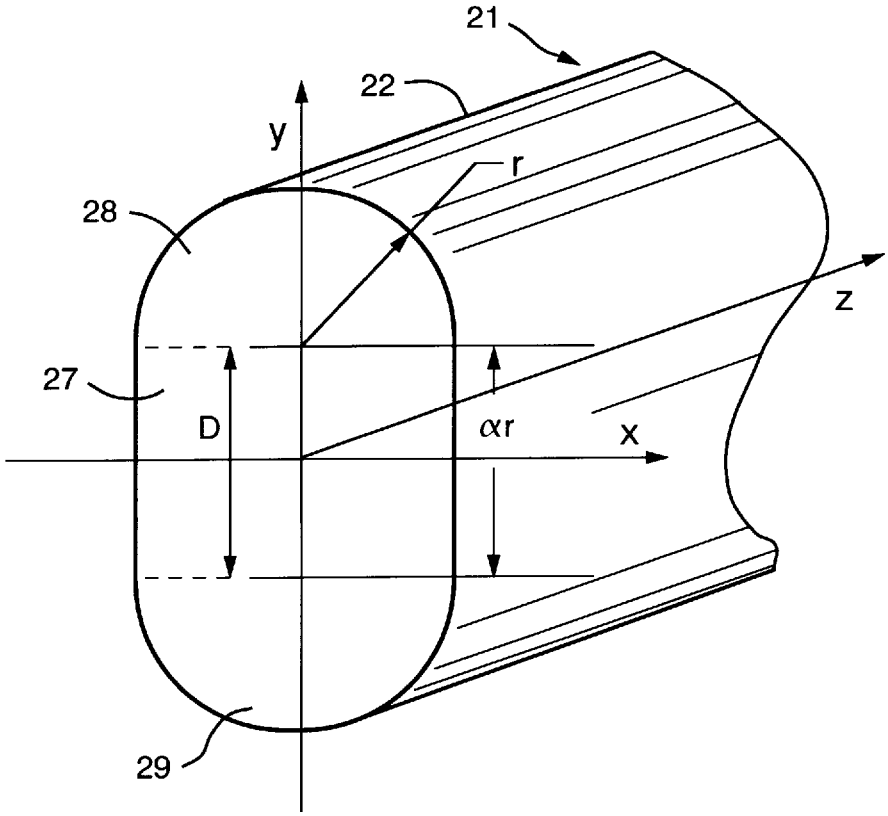
FIG. 2 (PRIOR ART)
FIG. 2 is a cross section of a portion of a core wire used in a prior art wound piano string that is useful in understanding this invention.

FIG. 2 depicts the cross section of a conventional wound bass string 20 in the swaged area wherein the cross section lies in an x-y plane and the core wire 21 extends along a z axis. Swaging or otherwise flattening the wire does not change the cross-sectional area appreciably, so for purposes of understanding this invention the cross section can be considered to remain constant albeit a different or flattened shape. The cross-sectional area of the flattened portion can be defined as a central rectangular cross section 27 having a height "D" with outlined semi-circular areas 28 and 29 on each side of the rectangle 27. The moments of inertia in the two orthogonal directions are obviously not the same and are easily calculated. If $B_x$ and $B_y$ represent the two values in the inharmonicity factor, then the contributions to the inharmonicity factors by vibration the x and y directions are as follows:

$$B_x = \left(1 + \frac{8}{3\pi}\alpha\right)\left(\frac{\pi}{\pi + 2\alpha}\right)^2 B_{core} \tag{3}$$

and $$B_y = \left(1 + \frac{16}{3\pi}\alpha + \alpha^2 + \frac{2}{3\pi}\alpha^3\right)\left(\frac{\pi}{\pi + 2\alpha}\right)^2 B_{core} \tag{4}$$

where $\alpha$ is the representation of the eccentricity of the flattened section such that:

$$\alpha r = D \tag{5}$$

where r represents the radius of the two semi-circular areas 28 and 29. Thus frequencies produced by vibration components in the y direction and in the x direction are different. The splitting of the inharmonicities gives rise to false beats that are proportional to the ratio of $B_y/B_x$.

Figure 3:
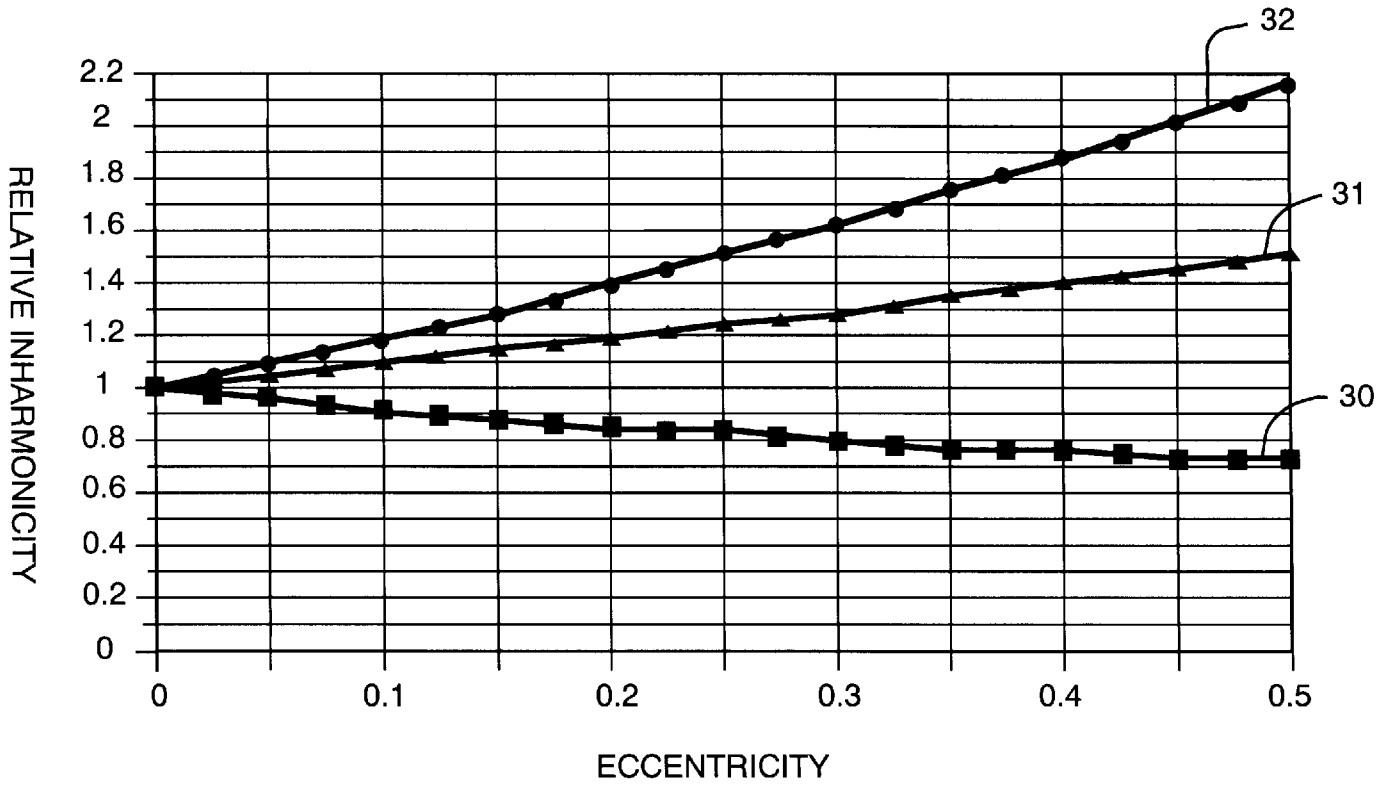
FIG. 3 (PRIOR ART)
FIG. 3 is a graphical analysis of characteristics of a prior art wound string.

FIG. 3 depicts these effects graphically for a typical prior art wound string. Graph 30 depicts an inharmonicity that varies negatively with respect to the minor principal axis; the inharmonicity varies positively along the major principal axis as represented by graph 31. Graph 32 represents the ratio of these inharmonicities. As apparent the inharmonicity can produce a significant change at very low levels of eccentricity. For example, a 1.4 cent inharmonicity ratio in the A0 string (27.5 HZ) typically produces a beat frequency of about 0.29 Hz. At a frequency corresponding to the A4 note (i.e., 440 Hz), the beat is 4.62 Hz and audible.

Figure 4:
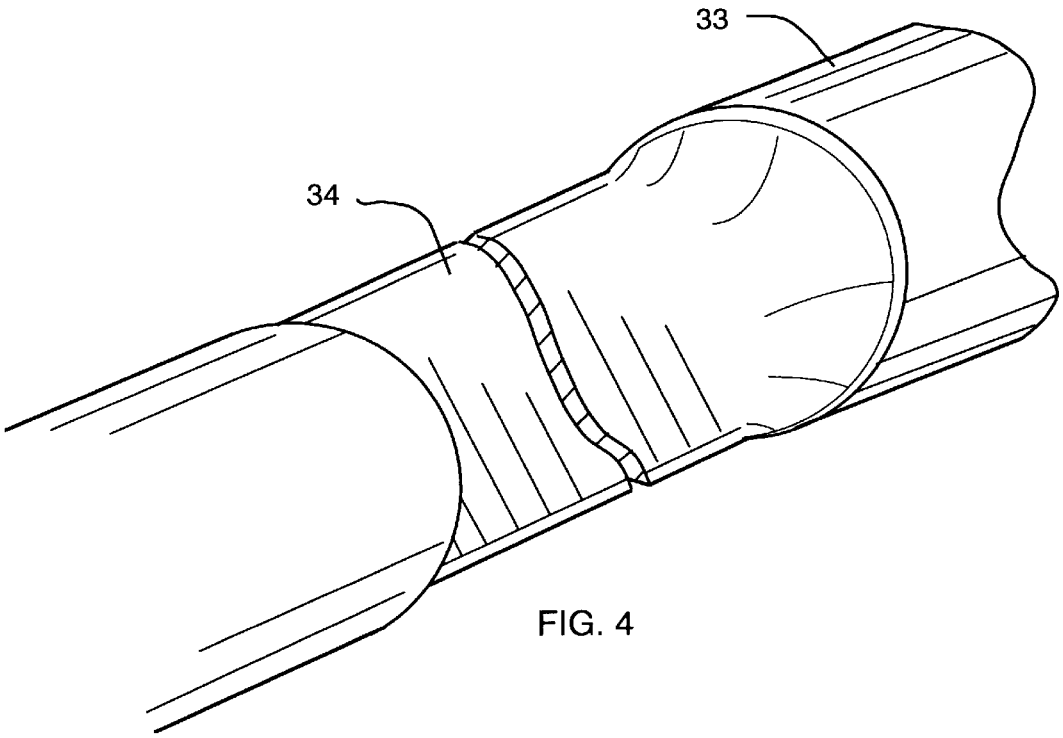
FIGS. 4 and 5 depict one embodiment of a wound string constructed in accordance with this invention.
Figure 5:
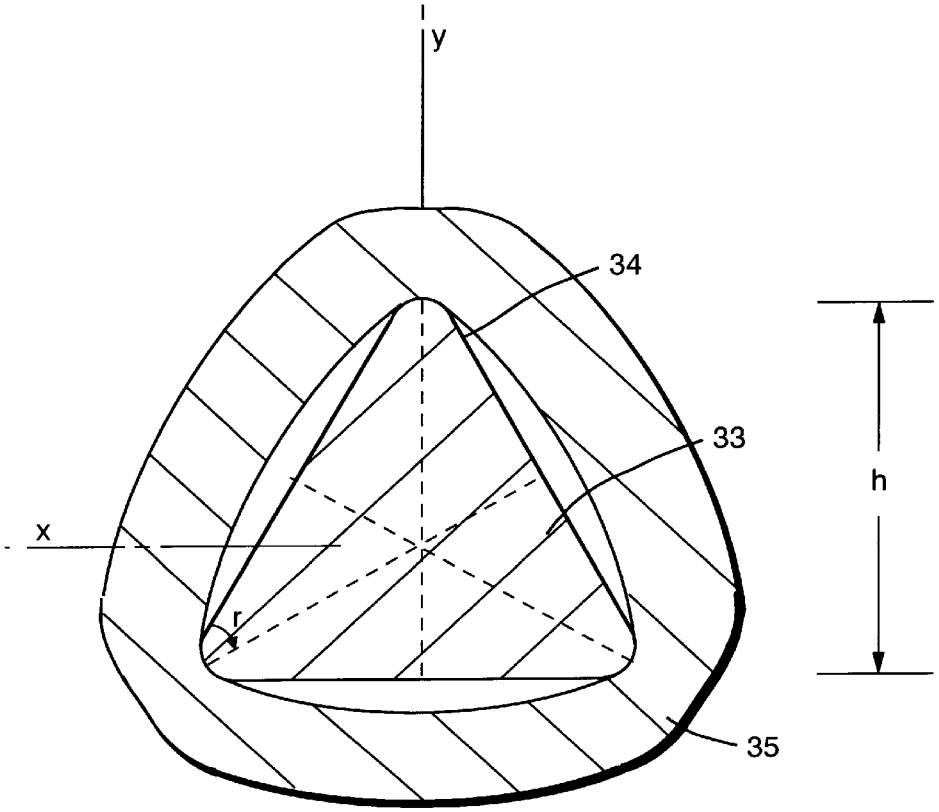

FIGS. 4 and 5 depict one embodiment of a portion of a core wire 33 that can replace the core wire 21. The core wire 33 has two transition sections that correspond in position and length of the end turns 24 in FIG. 1. One transition section 34 is shown and has the cross section of an equilateral triangle. As previously indicated, the transition section 41 would be coextensive with the end turns, such as the end turns 24 in FIG. 1. FIG. 5 depicts end turns 35 wrapped around the transition section 34. The transition section 34 has a height h. If the intersection of the x and y axes is located on the centroid of the triangle and it is assumed the radius of the corners is r=0, the principal moments of inertia Ix and Iy are:

$$I_x = I_y = \frac{h^4}{18\sqrt{3}} \tag{6}$$

The radius r is small, but finite, to prevent cutting of the copper winding during the wrapping process. Mathematically it has no effect on the result so r=0 is a valid assumption.

Since the principal moments of inertia as shown in equation (5) are independent of the direction of the axis passing through the centroid, so also is the inharmonicity. This means that passing from a flat section to a triangular one is not simply an improvement in the mode splitting operation. It represents a solution that prevents vibration in the orthogonal modes from producing different frequencies and therefore prevents the generation of false beats. Stated differently, according to equation (5) a transition section having a cross section in which the principal moments of inertia are equal will not introduce false beats.

Figure 6:
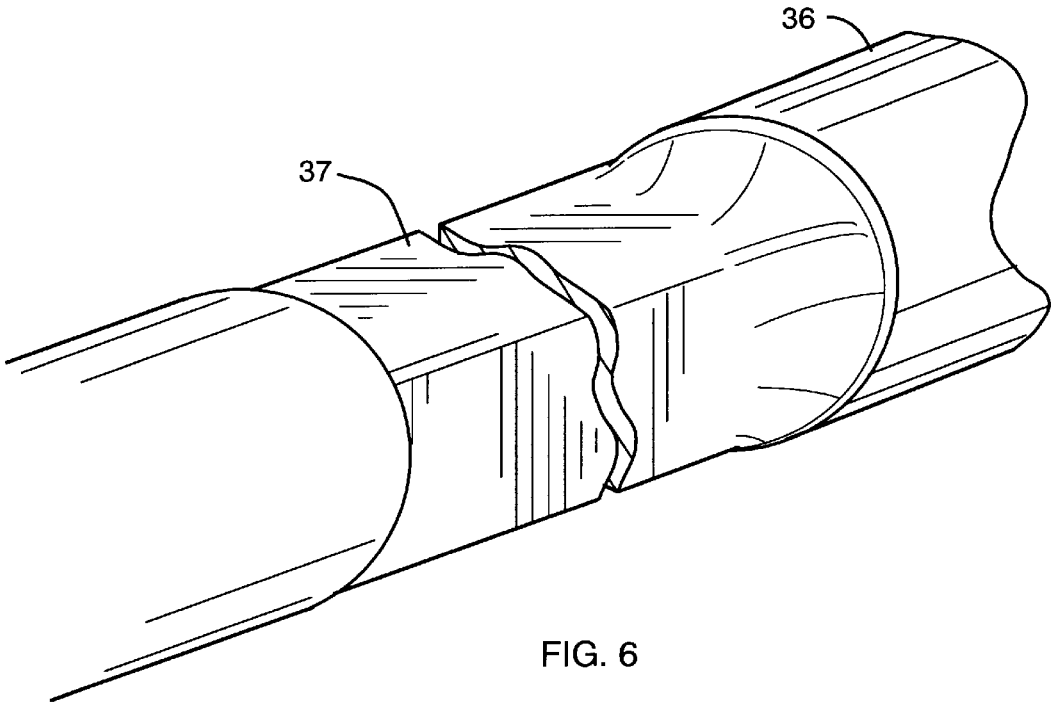
FIGS. 6 and 7 depict another embodiment of a wound string constructed in accordance with this invention.
Figure 7:
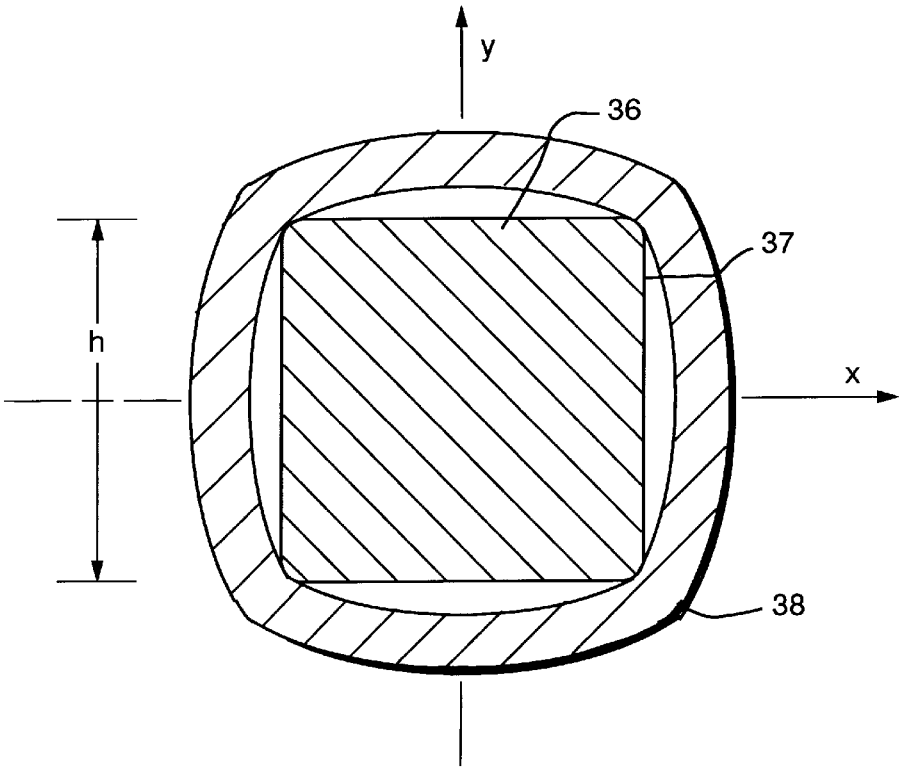

FIGS. 6 and 7 depict another core wire 36 that has a transition section 37 with a square cross section that, as shown in FIG. 7, is wrapped with end turns 38. In an actual embodiment the corners would, as in FIGS. 4 and 5, be radiused to prevent cutting of the copper winding during the wrapping process. However the effect of the radius on the principal moments is insignificant. In essence when one looks at the centroid of the square cross section, the principal moments of inertia are:

$$I_x = I_y = \frac{h^4}{12} \tag{7}$$

Thus, this cross section also satisfies the criterion for equal principal moments of inertia so the transition section exhibits zero dependence of inharmonicity in any axial direction. Again this provides a perfect solution for the mode splitting problem.

Although the square cross section provides a solution, in practice it is difficult to obtain a perfect square. Equilateral triangular cross sections, however, can be achieved with reasonable ease. Consequently, it is expected that the cross sections of FIGS. 4 and 5 will be preferred. It will also be apparent that other cross-sectional shapes can be used that will exhibit the characteristics of equal principal moments of inertia.

Figure 8:
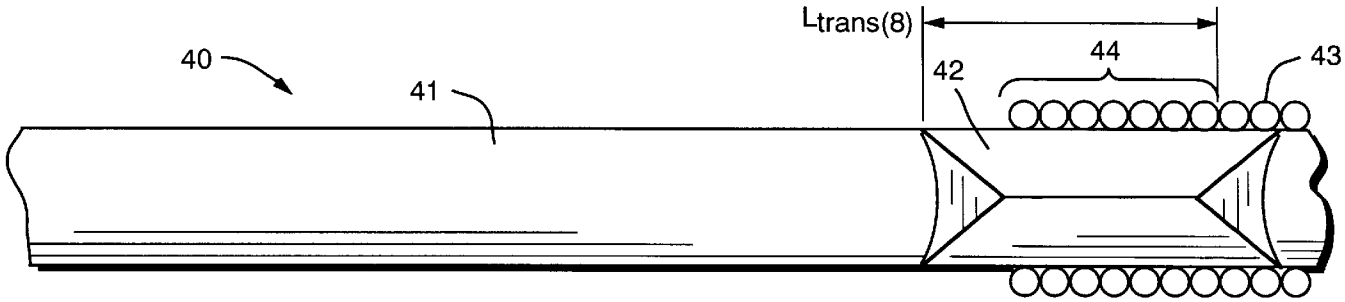
FIGS. 8 through 10 depict portions of single-, double- and triple-wound bass strings constructed in accordance with this invention.

FIG. 8 depicts a portion of a single-wound string 40 that has a core wire 41 including a transition section 42 that underlies a portion of a single wrapping layer 43 including end turns 44 of which only one is shown. Only the end turns 44 lie in the transition section 42. The transition section has a length of $L_{trans}(8)$.

Figure 9:
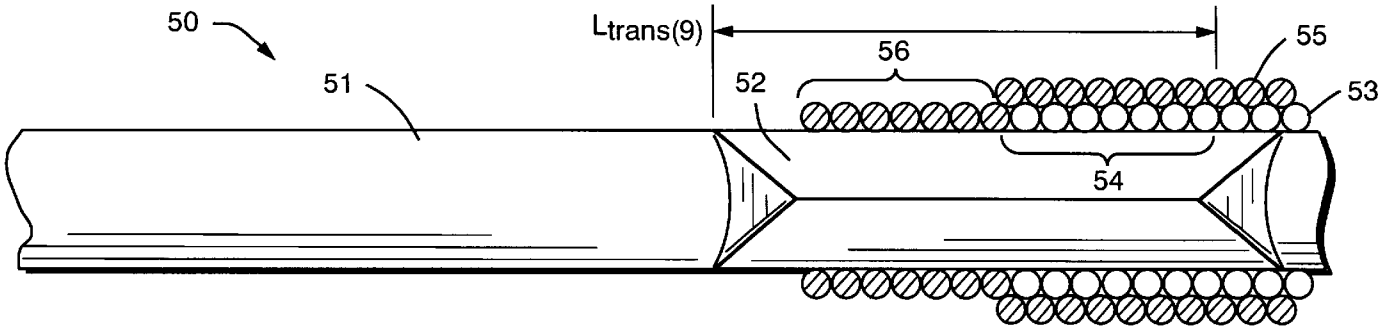

FIG. 9 depicts a double-wound bass string 50 that includes a core wire 51 and a transition section 52. In this case an inner winding 53 includes end turns 54. An outer winding 55 includes end turns 56, and both the end turns 54 and 56 are wrapped contiguously about and directly on the transition section 52. Consequently, as the transition section of FIG. 8 must accommodate end turns 54 and 56, the length $L_{trans}(9)$ of the transition section 52 is greater than that of the transition section 42 in FIG. 8: i.e., $L_{trans}(9)>L_{trans}(8)$.

Figure 10:
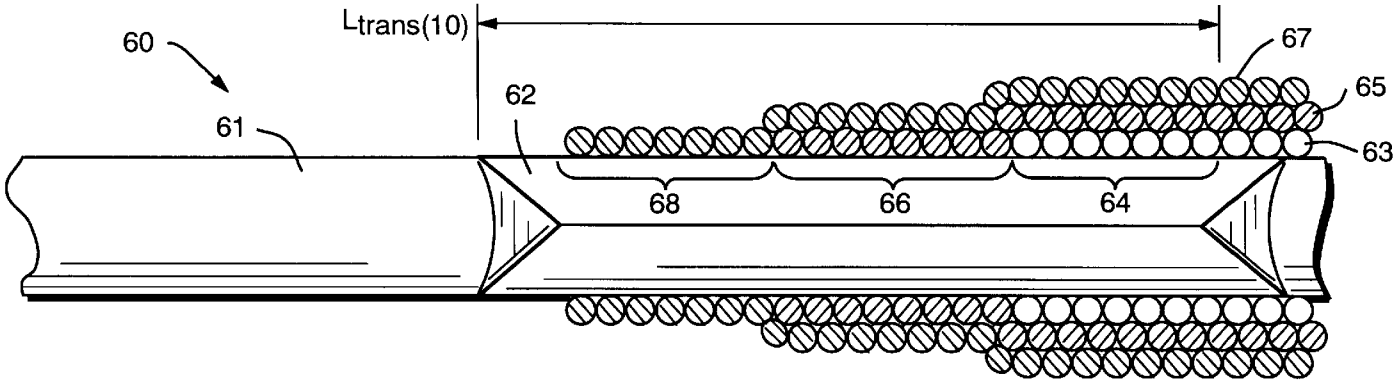

FIG. 10 depicts a triple-wound bass string 60. A core wire 61 includes a transition section 62 having a length $L_{trans}(10)$ that is greater than the corresponding dimensions in FIGS. 8 or 9: i.e., $L_{trans}(10)>L_{trans}(9)>L_{trans}(8)$. In this case the inner-most covering 63 has end turns 64. A second or intermediate winding 65 includes end turns 66 wrapped on the transition section 62 contiguous to end turns 64. The third or outer covering 67 has end turns 68 that also wrap directly on the transition section 62 contiguous to end turns 66. Since the transition length does not cause inharmonicity mode splitting, it can be as long as physically desirable. In fact, the transition length could extend the whole length of the winding, if desired.

Figure 11:
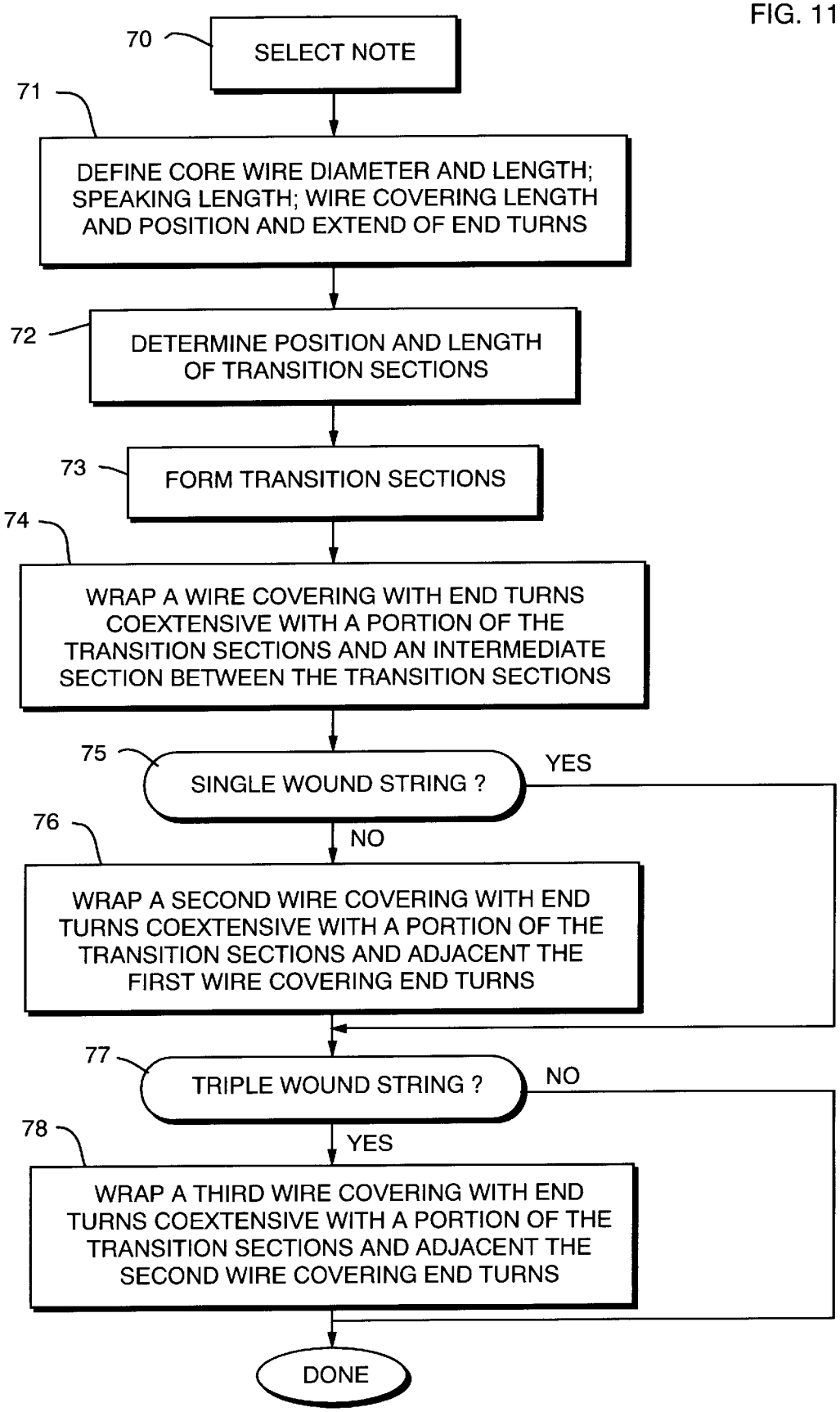
FIG. 11 is a flow chart of a process for making a wound string in accordance with this invention.

FIG. 11 outlines the manufacturing process by which a wound string can be constructed in accordance with this invention. In step 70 a note is selected. Step 71 uses conventional methods to define the core wire diameter, the speaking length and the wire covering length and position and extent of the end turns. This information enables the determination of the position and length of the transition sections for the string in step 72.

Step 73 forms the transition sections, such as the transition section 34 in FIGS. 4 and 5 and transition section 37 in FIGS. 6 and 7. Step 74 represents the wrapping of a first covering with end turns being coextensive with an intermediate portion between the transition sections.

In accordance with this invention step 73 produces a transition section having a cross section that exhibits equal principal moments of inertia, such as cross sections in the shapes of equilateral triangle or square of FIGS. 4 and 6. Other examples are also possible as previously suggested.

The next step is to determine whether the wound string is a single-wound string. If it is, step 75 diverts past step 76 to step 77. In step 76, a second wire covering is wrapped to produce a cross section as shown in FIG. 9. In this embodiment, the end turns for each layer are located in adjacent or contiguous portions of the transition sections.

If the string is not a triple-wound string, then in step 77 the process is complete and has produced a double-wound string as shown in FIG. 9. If the string is a triple-wound string, step 77 diverts to step 78 to provide a third, or outer layer. Again the end turns of each layer will be wrapped directly in contiguous portions of each transition section. When completed, a triple-wound string as shown in FIG. 10 will exist.

In summary there is disclosed a method for producing wound musical strings according to a configuration that eliminates a cause of false beats. Applicant's invention relates to forming transition sections having a cross section that exhibits equal principal moments of inertia, about any two orthogonal axes in the plane of the cross section. The application discloses two particular embodiments that satisfy this requirement, namely strings in which the cross section of transition sections under the end turns has the shape of an equilateral triangle or a square. Other embodiments could also be used that satisfy the necessary moment of inertia requirements and further provide a surface about which the wrapping wire can be wound permanently and with integrity.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters Patent of the United States is:

1. A musical string for minimizing false beats generated thereby, said musical string comprising a core wire and a wound wire covering having intermediate turns and end turns, said core wire extending axially to define opposite bare end sections, an intermediate section coextensive with said intermediate turns of said wound wire covering and a transition section between each bare end section and said intermediate section that is coextensive with at least said end turns, the core wire in each of said bare end and intermediate sections of said core wire having a circular cross section and the core wire in each of said transition sections having a cross section that differs from the cross section of the core wire in said bare end and intermediate sections and that exhibits equal principal moments of inertia.

2. A musical string as recited in claim 1 wherein a transition section has an equilateral triangular cross section.

3. A musical string as recited in claim 1 wherein a transition section has a square cross section.

4. A musical string as recited in claim 1 wherein each of said transition sections has an equilateral triangular cross section.

5. A musical string as recited in claim 1 wherein each of said transition sections has a square cross section.

6. A musical string for minimizing false beats generated thereby, said musical string comprising a core wire and a wound wire covering having intermediate turns and end turns, said core wire extending axially to define opposite bare end sections, an intermediate section coextensive with said intermediate turns of said wound wire covering and a transition section between each bare end section and said intermediate section that is coextensive with at least said end turns, each of said bare end and intermediate sections of said core wire having a circular cross section and each of said transition sections has a regular polygonal cross section that exhibits equal principal moments of inertia.

7. A musical string as recited in claim 6 wherein each of said transition sections has the cross section of an equilateral triangle.

8. A musical string as recited in claim 6 wherein each of said transition sections has a square cross section.

9. A musical string as recited in claim 6 wherein said wound wire covering comprises a first winding with intermediate turns and end turns, said end turns being wrapped in said transition sections.

10. A musical string as recited in claim 9 wherein each of said transition sections has the cross section of an equilateral triangle.

11. A musical string as recited in claim 9 wherein each of said transition sections has a square cross section.

12. A musical string as recited in claim 6 wherein said wound wire covering additionally comprises a second winding with an intermediate turns about said first winding and end turns on said core wire, said end turns of said second winding being wrapped in said transition sections.

13. A musical string as recited in claim 12 wherein said wound wire covering additionally comprises a third winding with an intermediate turns about said second winding and end turns on said core wire, said end turns of said third winding being wrapped in said transition sections.

14. A musical string as recited in claim 13 wherein each of said transition sections has the cross section of an equilateral triangle.

15. A musical string as recited in claim 13 wherein each of said transition sections has a square cross section.

16. In a method for producing a wound musical string including a circular core wire and a wire wrapped about the core wire, said method including the steps of:

A. forming spaced transition sections in the core wire defining an intermediate section therebetween, said forming of each transition section including forming the cross section thereof to be different from the cross section of the core wire in the intermediate section and to have equal principal moments of inertia; and B. forming the wrapped wire onto the core wire intermediate the transition sections with end turns of the wrapped wire overlying each of the transition sections.

17. A method as recited in claim 16 wherein said step of forming a transition section produces an equilateral triangular cross section.

18. A method as recited in claim 16 wherein said step of forming each transition section produces a square cross section.

19. A method as recited in claim 16 wherein the wound musical string is a single wound string and the wire covering is a single-layer wrap of wire, the transition sections being formed with a length that receives the end turns of the single-layer wrap of wire.

20. A method as recited in claim 16 wherein the wound musical string is a double-wound string and the wire covering is a double-layer wrap of wire, the transition portions being formed with a length that receives the end turns of each layer of the double-layer wrap contiguously on each of the transition sections.

21. A method as recited in claim 16 wherein the wound musical string is a triple-wound string and the wire covering is a triple-layer wrap of wire, the transition portions being formed with a length that receives the end turns of each layer of the triple-layer wrap contiguously on each of the transition sections.

* * * * *